US005842697A

United States Patent [19]

Scott et al.

[11] Patent Number: 5,842,697

[45] Date of Patent: Dec. 1, 1998

[54] POLYHEDRAL SURFACE JIGSAW PUZZLES

[76] Inventors: Donald W. Scott, 8267 State Rd., Colden, N.Y. 14033; Loren S. Muldowney, 1711 Parker Rd., Highland Park, N.J. 08904-3747

[21] Appl. No.: 648,651

[22] Filed: May 15, 1996

[51] Int. Cl.[6] ..... A63F 9/12

[52] U.S. Cl. ..... 273/157 R; 428/33

[58] Field of Search ..... 273/157 R; 428/33

[56] References Cited

U.S. PATENT DOCUMENTS

| | | | |
|---|---|---|---|
| 2,987,318 | 6/1961 | Hammer | 273/157 R |
| 3,578,331 | 5/1971 | De Gast | 273/157 R |
| 3,689,075 | 9/1972 | Adelsohn | 273/157 R |
| 3,819,188 | 6/1974 | Freedman | 273/160 |
| 4,625,969 | 12/1986 | Donnell | 273/157 R |
| 5,217,226 | 6/1993 | Christopher | 273/157 R |
| 5,251,900 | 10/1993 | Gallant | 273/157 R |
| 5,351,957 | 10/1994 | Scott | 273/157 R |

*Primary Examiner*—Henry F. Epstein

[57] ABSTRACT

The invention comprises a continuous surface made from jigsaw puzzle pieces, wherein the three or more pieces whose corners share a common point when assembled, have corner angles whose sum is less than 360 degrees with the common point as vertex of said corner angles. The present invention makes it possible to work on jigsaw puzzles which, when assembled and during assembly, form continuously curving polyhedral surfaces, and to provide a jigsaw puzzle whose pieces assemble edge to edge into a self-supporting curved surface which is a closed multifaceted polyhedron whose appearance is substantially spherical.

20 Claims, 7 Drawing Sheets

POLYHEDRAL SURFACE JIGSAW PUZZLES

BACKGROUND OF THE INVENTION

Jigsaw puzzles have been in existence for about two hundred fifty years. Usually, a piece of art is laminated or printed on a wooden, paper or plastic board and the board is subsequently cut into many, sometimes interlocking, pieces. It is then a challenging activity to reassemble the pieces by matching shapes, colors, and patterns. The usual form of such puzzles is a flat, two-dimensional scene. When the puzzle pieces are reassembled, the flat scene reappears and the puzzle worker gets satisfaction from restoring order from apparent chaos. Recently jigsaw puzzles have been developed which involve the assembly of interlocking or interfitting pieces into three dimensional structures (U.S. Pat. No. 5,251,900: Paul Gallant and U.S. Pat. No. 5,351,957: Donald Scott). Jigsaw puzzle workers enjoy a challenge. The greater the challenge, the greater their pleasure and satisfaction.

Their challenge has been increased by making the shapes of pieces more nearly identical, by making the colors more and more similar, by making any differences in patterns of line and color less discernible, and of course by increasing the number of pieces. The classical jigsaw puzzle skills involve discriminating among larger and larger numbers of pieces to detect tiny differences in shape, size, and pattern. Recently there have been skills of logic added to those traditional skills (Scott Patent). Historically, jigsaw puzzle workers have applied their skills to assemble plane surfaces. There are also products which allow the plane surfaces to intersect in ways which form structures (Gallant Patent). Until the present invention, however, it has never been possible for a puzzle worker to begin with ordinary die-cut paperboard puzzle pieces and to assemble a self-supporting surface like a hill, or a ball, or a golf green.

Although not strictly jigsaw puzzles, there have been several methods of allowing puzzle workers to assemble spherical surfaces. One method, successful although expensive, involves a magnetic metal surface on which are placed flexible magnetic puzzle pieces. The magnetic pieces are extremely thin and do not depend on any stiffness of their own either to form the curved surface or to hold contiguous pieces together and in the proper relative positions. Another method comprises molded plastic pieces with curved outer surfaces and complex molded interlocks (U.S. Pat. No. 3,689,075: Adelsohn, 1972). Another method comprises a central core from which protrude pins. These pins support and position surface pieces which are curved to form a spherical surface (U.S. Pat. No. 2,987,318: Hammer, 1961). Still another method comprises interlocking identically shaped pieces which are rigid and have a spherically curved outer surface. The identical pieces are grouped in clusters of five and three pieces (U.S. Pat. No. 3,578,331: DeGast, 1971). All methods for making spherical puzzles or "jigsaw puzzles" which assemble into a spherical surface involve supporting the pieces from the side away from the art, the use of spherically curved outer surfaces on the pieces, molded or machined interlocks, or combinations of the forementioned features. In still another form of puzzles, although not a jigsaw puzzle, a regular polyhedron shell of some reasonable thickness is cut in such a way that it can be separated into pieces which can then become an interesting challenge to reassemble or to use as a construction toy. The puzzles have edges divided into thirds with interfitting, though not interlocking, means at the middle third of each edge and other interfitting means at each corner. The pieces reassemble to form perfect polyhedron faces and neither interlock nor fit edge to edge. The reassembled faces can be secured with pins if desired (U.S. Pat. No. 3,819,188: Freedman, 1974).

OBJECT OF THE PRESENT INVENTION

Jigsaw puzzles are typically sawed or stamped from flat, thin material such as wood or paper. In a fully interlocking jigsaw puzzle, each piece has three or more sides and each side has one half of a coupling means for interlocking it to the side of another piece. Each piece is a flat or planar surface. If a continuous surface is made, using jigsaw puzzle pieces, whereon each puzzle piece is the same perpendicular distance from a fixed point, that surface is a polyhedral surface and if the surface is continued until it closes upon itself and the final pieces interlock with the starting pieces so that there are no unattached sides of any pieces, it is a closed polyhedron with puzzle pieces comprising its faces. If the number of pieces is large, over two hundred for example, and if the pieces are all nearly the same size, the polyhedron will mimic a sphere in appearance and the human eye will interpret its shape as spherical. One of the reasons for the spherical interpretation is that a polyhedron as described above with an infinite number of faces would, in fact, be a sphere. The human eye makes the blend which infinite pieces would make. Another reason is that the faces of the polyhedron are not polygons with straight sides. The sides are scroll shaped and the shape of the scroll plus the coupling element cause a large portion of the faces of the polyhedron to interlock with each other in such a way that the surface is curved by the interlocking forces and approximates a spherically curved surface. This complex bending encourages the human eye to interpret the surface as continuously curved and spherical. Of course the art which decorates the puzzle lends to the spherical interpretation. For example, an accurate representation of continents and oceans as in a globe would reinforce the spherical interpretation.

Until the present invention there has never been a self supporting jigsaw puzzle made of ordinary paperboard which assembles into a closed polyhedron with edge to edge interlocking only. Even the methods for cutting ordinary jigsaw puzzles preclude their holding together tightly enough to form a self supporting, rigid, curving polyhedral surface. It is an object of the present invention to provide another dimension in making and solving jigsaw puzzles, to add different skills to the classical and growing arsenal of skills required for solving jigsaw puzzles, to make it possible to work on jigsaw puzzles which, when assembled and during assembly, form continuously curving polyhedral surfaces, to provide a jigsaw puzzle whose pieces are all connected edge to edge and which will form a self-supporting continuously curving polyhedral surface, to provide jigsaw puzzles which assemble into both open and closed self-supporting polyhedral surfaces, and to provide a jigsaw puzzle whose pieces assemble edge to edge into a self-supporting curved surface which is a closed multifaceted polyhedron all of whose vertices lie on the surface of a circumscribed sphere and whose appearance is substantially spherical.

DETAILED DESCRIPTION OF THE INVENTION

Figure 1:
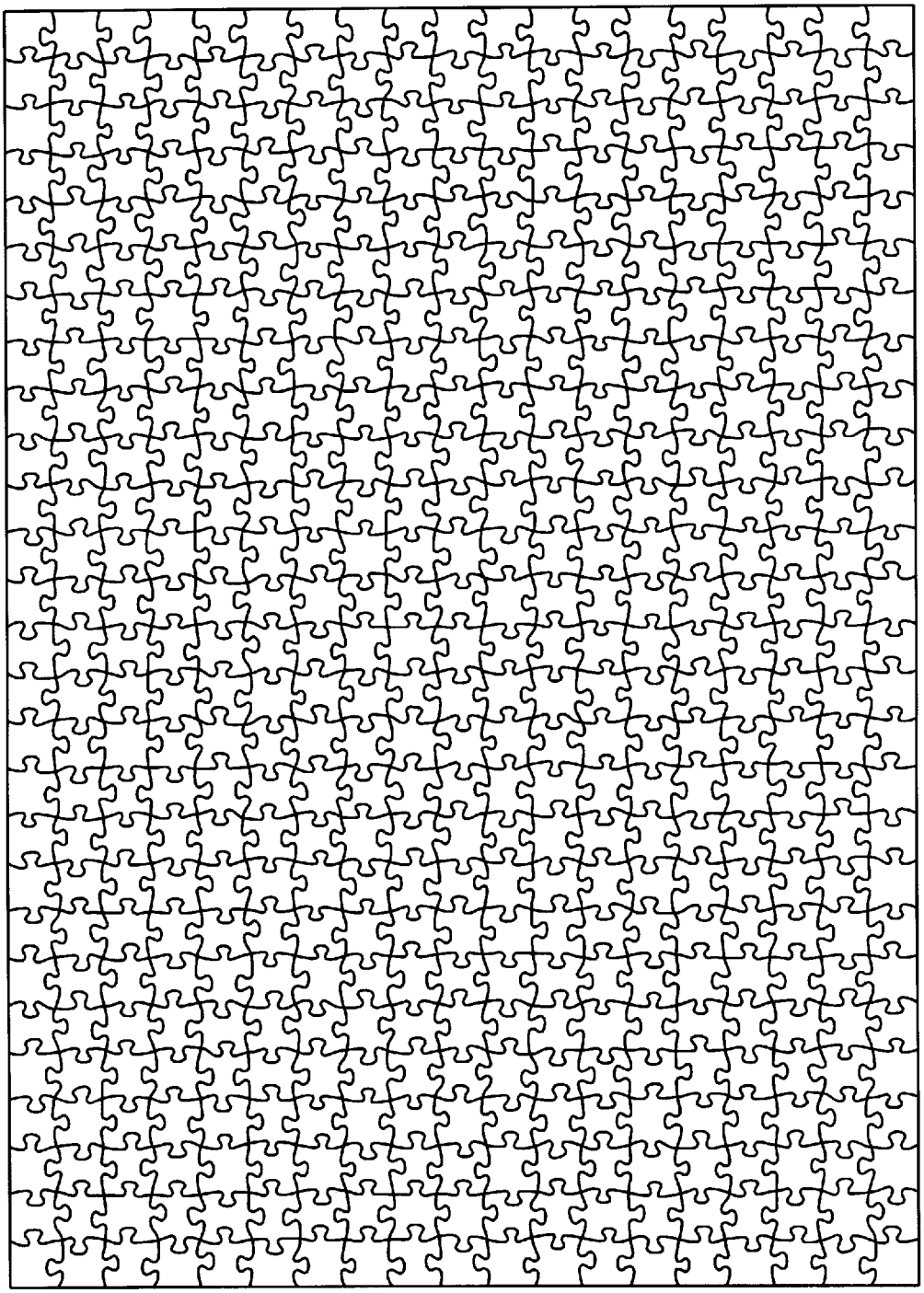
FIG. 1 is a plan view of an ordinary plane-surface jigsaw puzzle in an "as-cut" condition. It has 513 pieces.

FIG. 1 shows a typical paperboard jigsaw puzzle, "as-cut." Each corner piece is coupled to two other pieces. Each edge piece other than the corner pieces is coupled to three other pieces, and every interior piece is coupled to four other pieces. The puzzle pieces are reassembled into the same configuration they occupied when originally cut.

Figure 2:
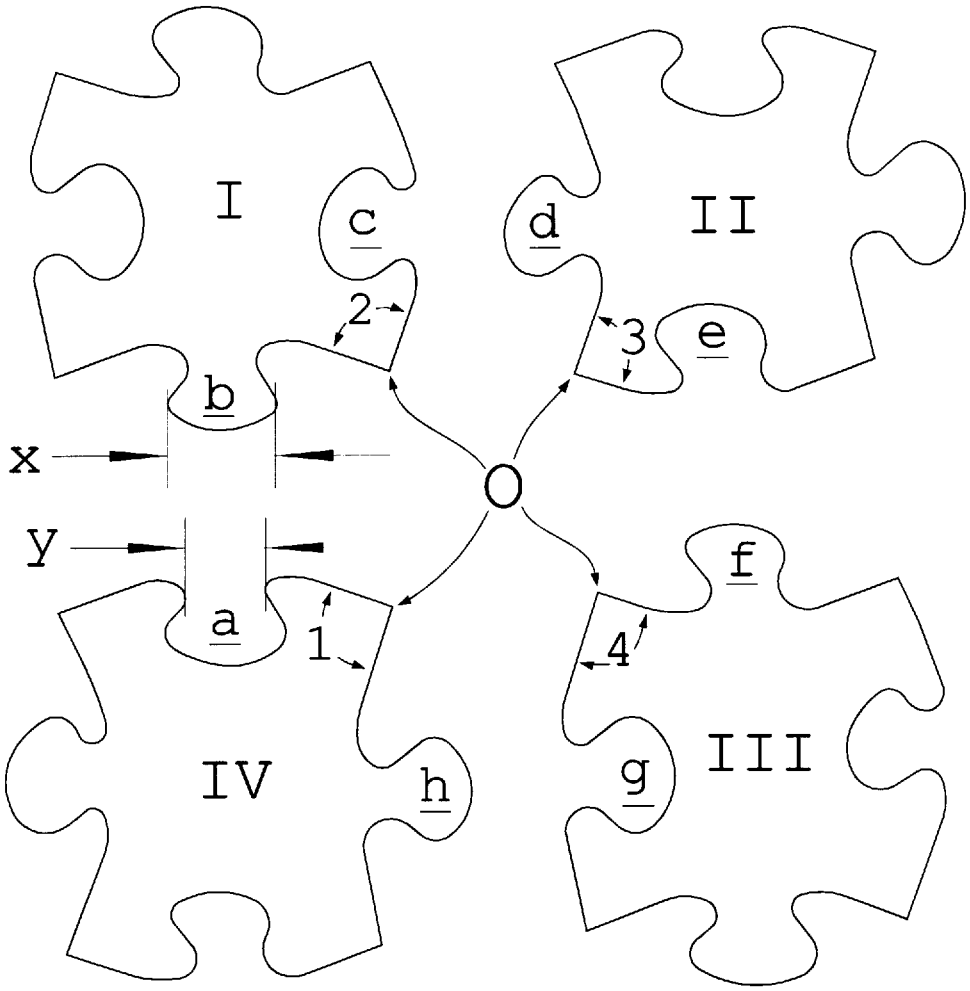
FIG. 2 is an enlarged plan view of four typical pieces of an ordinary plane-surface jigsaw puzzle in position to be assembled.

FIG. 2 shows four typical interior pieces from FIG. 1. These four pieces, when assembled, will have a common point at "O". The interlocking means of these four pieces are ordinary puzzle "locks" and are represented by the cooperative pairs of coupling elements a and b, c and d, e and f, and g and h. Referring to typical pair a and b, it is obvious that, in the plane of the four puzzle pieces, when male element b is placed inside female element a, since width x of element b is greater than width y of element a, piece I is attached and "locked" to piece IV by the cooperative pair of coupling elements a and b. The foregoing means of interlocking is well known to anyone familiar with the art and in itself is not a part of this invention or the preferred embodiment thereof. It will be noticed that although the shapes of both the male and female halves of the cooperative pairs of coupling elements are the same or similar, the sizes are different. Female element a is larger than male element b, element c is larger than element d, element e is larger than element f, and element g is larger than element h. This size difference wherein the female is larger than the male is a characteristic of all paperboard die-cut or sawed plane-surface jigsaw puzzles whose pieces are reassembled into the same juxtaposition they occupied when cut. The reasons will become obvious in FIG. 3. When pieces I, II, III, and IV are assembled to each other they will have a common corner at O. Angles 1, 2, 3, and 4 are the interior corner angles of the four pieces. The sum of these four angles is 360 degrees. This is also a characteristic of all plane surface jigsaw puzzles. In a plane-surface jigsaw puzzle whose pieces are reassembled into the same relative juxtaposition they occupied when cut, the sum of all the interior corner angles of the three or more pieces whose corners meet in a common point is 360 degrees.

Figure 3A:
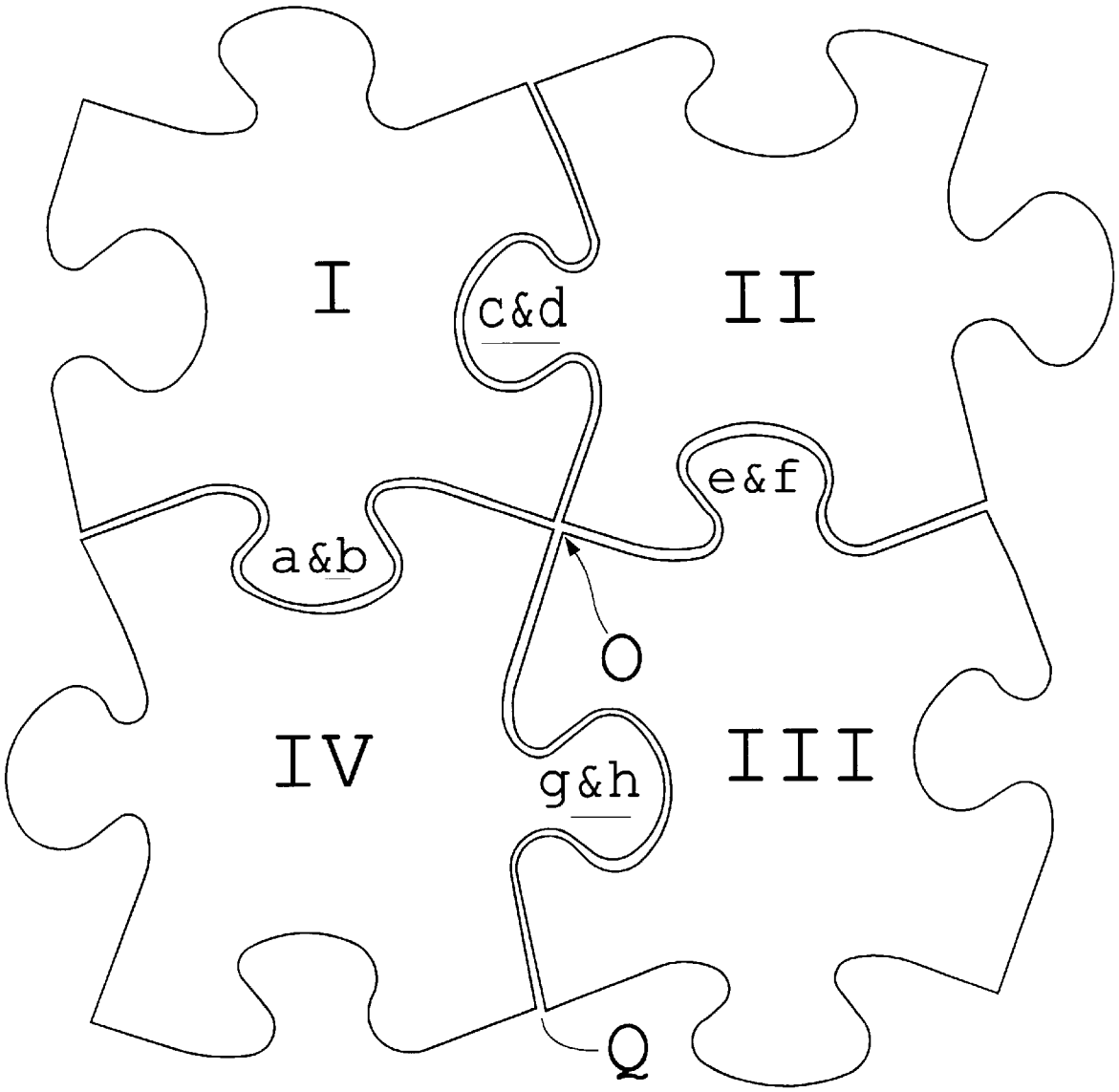
FIG. 3*a* shows the assembly of the four pieces from FIG. 2.
Figure 3B:
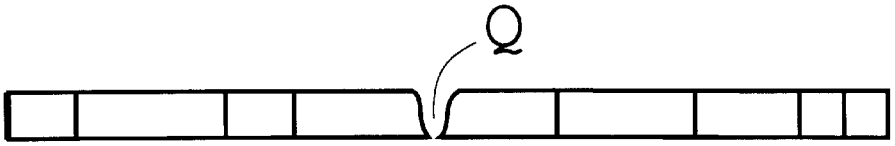
FIG. 3*b* shows an elevation view of the edge of the assembly of pieces from FIG. 3*a*.

FIG. 3*a* is an enlarged plan view of the four pieces of a regular plane-surface jigsaw puzzle from FIG. 2 in an assembled condition. The lines which represent the cuts between the pieces are shown as double lines. FIG. 3*b* is the elevation view of the edge of the four pieces in FIG. 3*a* and shows at Q a profile of the cut which separates the pieces. It is characteristic of all "knife-cut" paperboard jigsaw puzzles that the "knife" both slices and crushes the board as it is pushed through the board with a steady force. The crushing results in a kerf which measures somewhat less than the thickness of the knife. The finite width of the kerf (about two thirds the knife thickness) causes the cut to show as two lines representing opposite sides of the cut. As shown in FIG. 3*b*, the cutting also causes the upper edges of the kerf to be rounded as some crushing takes place before the slicing begins. The existence of the kerf causes the male coupling element to be smaller than the female coupling element by the width of the kerf all around except near the bottom of the cut where no further crushing takes place and the compressed paper and paperboard are cut against a hard surface. Sawed jigsaw puzzles have a similar kerf due to the removal of material during sawing. Because of the above described difference in size between the male and female coupling elements, ordinary jigsaw puzzles do not fit together tightly enough to cause an assemblage of pieces to be pulled by interlocking forces into a self-supporting surface.

Figure 4:
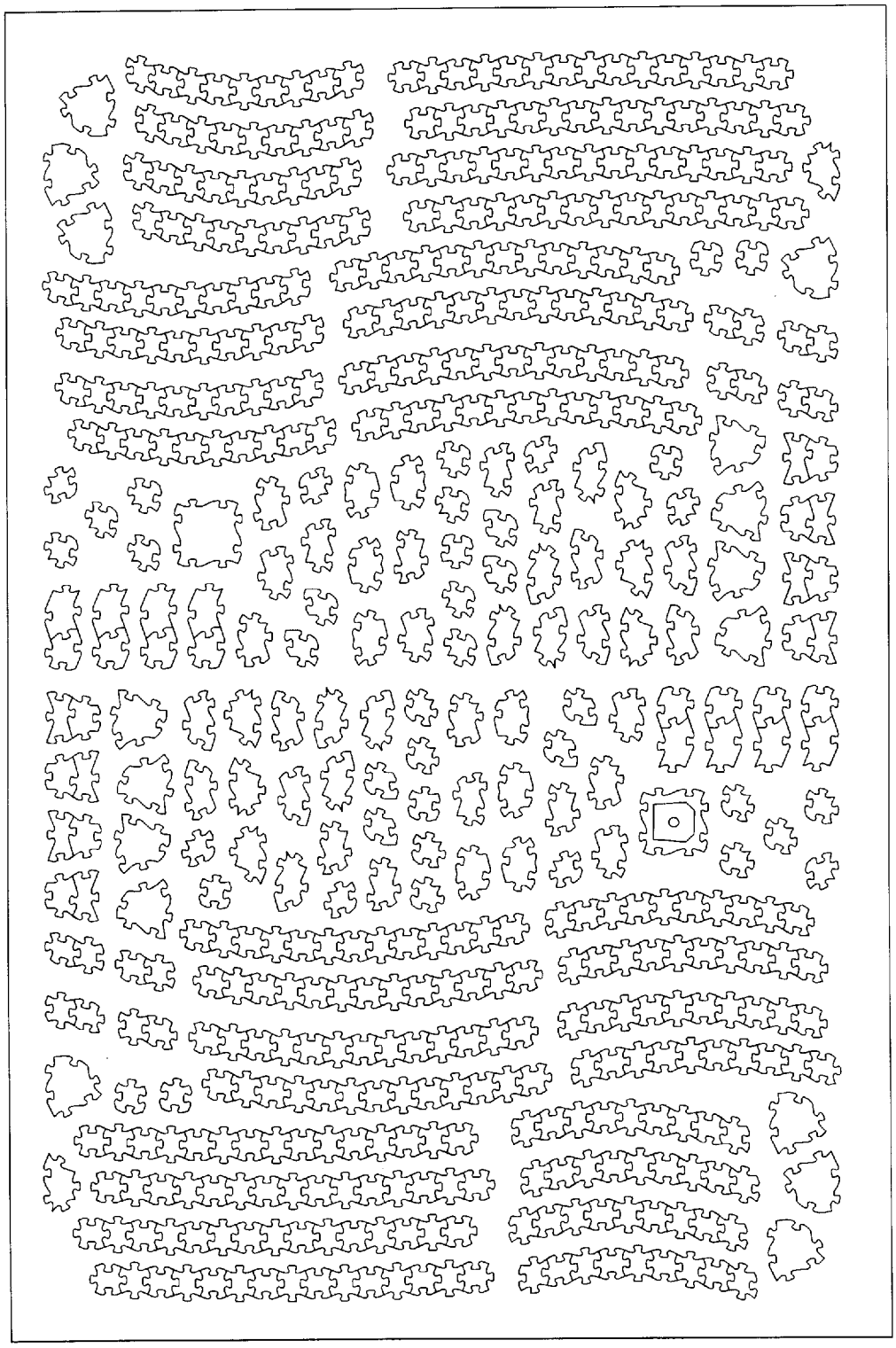
FIG. 4 is the plan view of a preferred embodiment of a continuously curving polyhedral surface jigsaw puzzle, as cut, with all artwork removed, and shows the lines which represent the cuts separating the interlocking puzzle pieces from the paperboard from which they are die-cut and the cuts separating the interlocking pieces from each other. The five hundred thirty pieces have a preferred but not essential order of reassembly.

FIG. 4 shows, as cut, in a single plane, a puzzle which is a preferred embodiment of the present invention before it is separated into waste material and pieces which can then be assembled and interlocked to each other. These pieces have a preferred, but not necessary, order of reassembly. There are a total of five hundred thirty pieces, many of which are cut individually, that is, cut while not attached to any other piece. The rest are cut while connected to no more than two other pieces. The paperboard from which the pieces are cut is a plane surface, but the pieces reassemble into a continuously curving polyhedral surface. The difference between the cutting of this preferred embodiment of a curved-surface jigsaw puzzle and the cutting of a regular plane-surface jigsaw puzzle will be apparent by comparing FIG. 4 to FIG. 1. In FIG. 4, nearly half of the material is recyclable waste. In FIG. 1 the pieces, as cut, are interconnected in the same plane surface and when broken up and reassembled will again form a plane surface. Except for a small amount of trim around an ordinary jigsaw puzzle, there is no waste.

Figure 5:
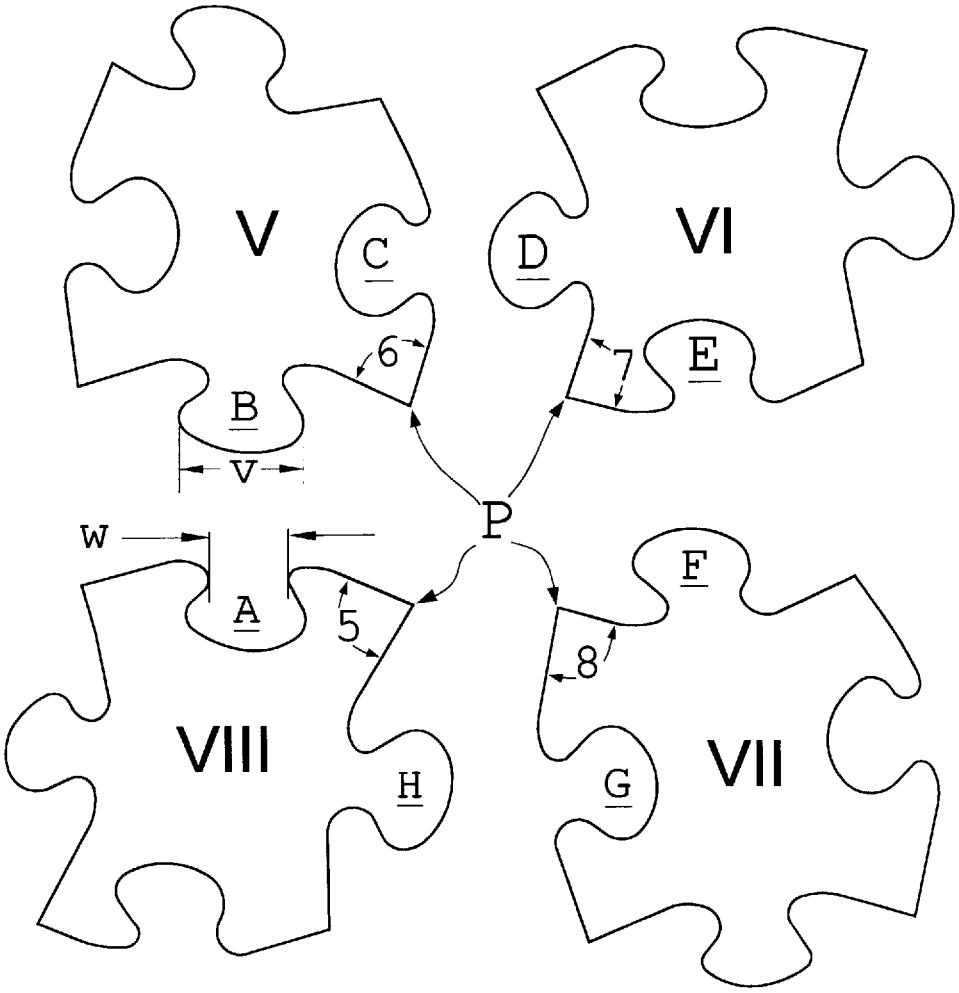
FIG. 5 is an enlarged plan view of four typical pieces of a preferred embodiment of a continuously curving polyhedral surface jigsaw puzzle in position to be assembled.

FIG. 5 shows an enlarged plan view of four typical pieces from a preferred embodiment of a continuously curving polyhedral surface jigsaw puzzle. Point "P" designates the corner point which the four pieces will have in common once they are assembled. Comer angles 5, 6, 7, and 8 have been exaggeratedly reduced in size for illustrative purposes. These four pieces, when assembled, are held together by cooperative pairs of coupling elements A and B, C and D, E and F, and G and H. Referring to coupling elements A and B, it can be seen that the width v of coupling element B is greater than the width w of coupling element A and that therefore piece V will be coupled securely to piece VIII if B is placed inside A. Unlike the cooperative pairs of coupling elements in FIG. 2 and FIG. 3*a*, around every typical point "P" in the preferred embodiment, at least two of the locking cooperative pairs of coupling elements will have the male coupling element the same size as or very slightly larger than the female coupling element. In FIG. 5, B is slightly larger than A and F is larger than E. The resulting friction or interference which is present when assembling B into A holds the two pieces together much more firmly than is possible with ordinary plane-surface jigsaw puzzle pieces.

Figure 6:
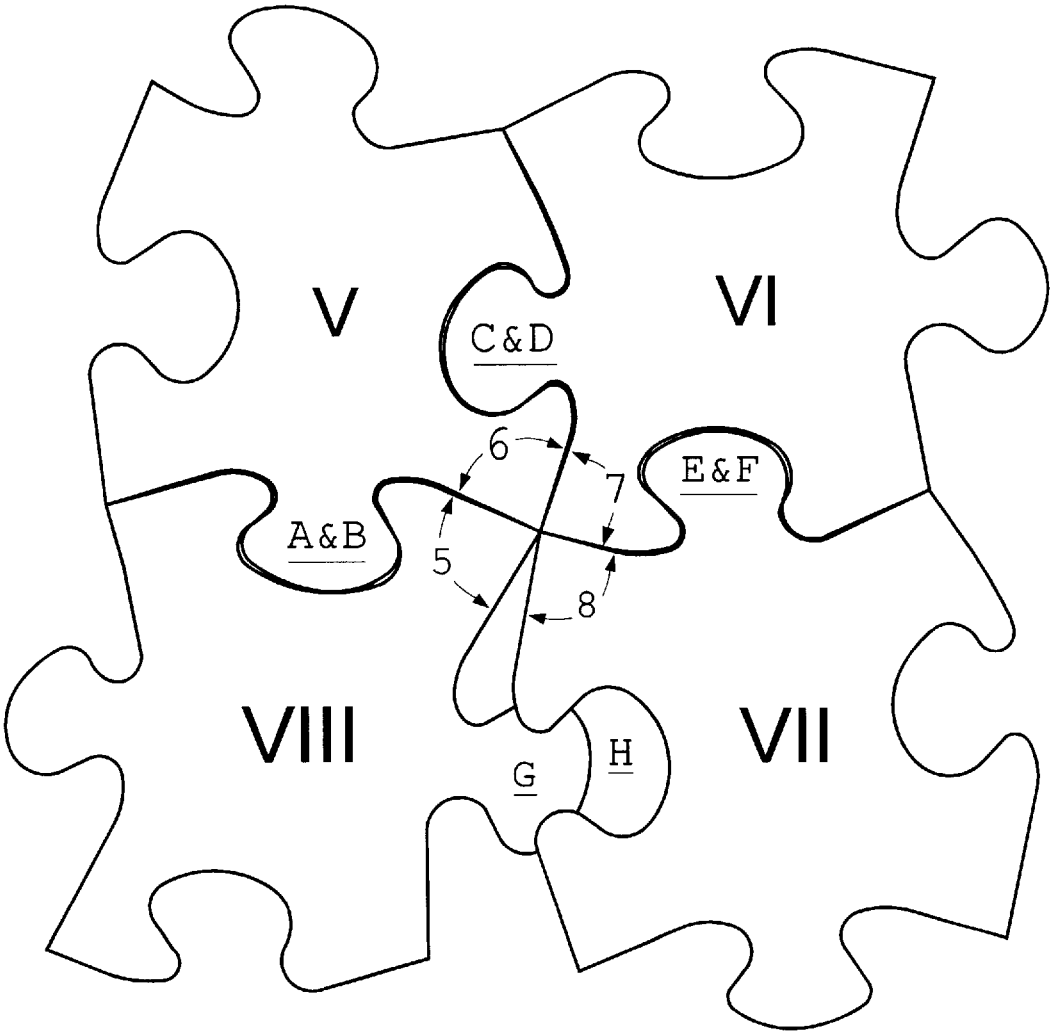
FIG. 6 is an enlarged plan view of four typical pieces of the preferred embodiment of a curving polyhedral surface jigsaw puzzle partially assembled with the fourth interlock remaining to be assembled.

The condition of friction or interference is made possible because this and over half of all cooperative pairs of coupling elements are not interlocked or connected at the time of cutting. Male element B is cut with a larger loop of knife than is female element A. Most of the kerfs which are formed as part of the cutting operation in the preferred embodiment are formed between the coupling elements and the waste. Although the establishment of friction or interference between more than half of the cooperative pairs of coupling elements is not essential in making a continuously curving polyhedral surface, it is essential in making the surface self-supporting and is therefore a part of the preferred embodiment of this invention. It can be seen that the sum of angles 5, 6, 7, and 8 is less than 360 degrees. If cooperative pairs of coupling elements A and B, C and D, and E and F were connected; locking piece VIII to piece V, piece V to piece VI, and piece VI to piece VII, there would be a large gap between piece VII and piece VIII as shown in FIG. 6. In order to connect piece VII to piece VIII it would be necessary to pick up the assembly of the four pieces in FIG. 6, pull piece VII to piece VIII and then couple piece VII to piece VIII using coupling elements G and H. The surface thus formed by the four pieces would then no longer be a plane surface but would begin to curve and in the preferred embodiment of the invention the continuously curving polyhedral surface thus formed is spherical in appearance. The shape of the polyhedral surface can be caused to vary from vertex to vertex but in the preferred embodiment the perpendicular distance from each puzzle piece to a common central point is kept constant by controlling the sums of the angles around every point of intersection in the puzzle. The points of intersection are the vertices of the polyhedral surface. A constant perpendicular distance from each face of a polyhedron to a common center point is the defining characteristic of a regular polyhedron, and a constant radius of curvature of a solid object defines a sphere.

In FIG. 6 there is a gap between Piece VII and Piece VIII because the sum of corner angles 5, 6, 7, and 8 is less than 360 degrees. When the gap is closed by connecting G to H, the four pieces are not in the same plane. The reason that the puzzle pieces in any embodiment of a continuously curving polyhedral surface cannot be connected at the time of cutting is now apparent. More than half of the male coupling elements must be cut with a larger loop of knife than their cooperative female elements, and the sum of the interior corner angles must be less than 360 degrees. If connected in a plane surface at the time of cutting it is impossible to cut the coupling elements with different sized knives and to have interior corner angles whose sum is less than 360 degrees.

Figure 7:
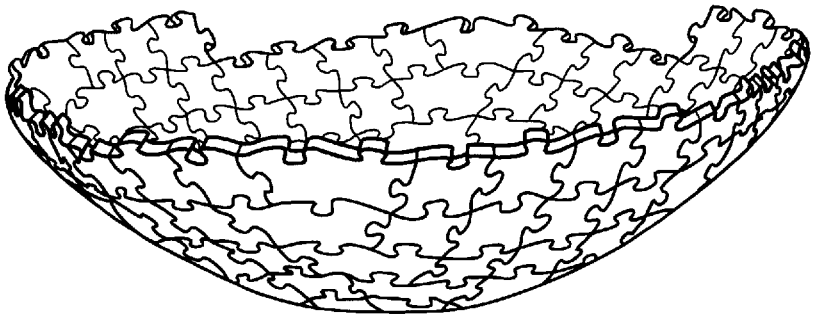
FIG. 7 shows the first one hundred pieces of the preferred embodiment of a continuously curving polyhedral surface jigsaw puzzle assembled to each other in a preferred order causing a portion of a spherical appearing polyhedron to take shape as the pieces are assembled.

FIG. 7 shows the first one hundred pieces of the preferred embodiment of the invention assembled in the preferred order. The lines which represent the cuts are not double lines because the two sides of the kerf are in close contact and show as one line. Since the sum of the vertex angles of the pieces which share each vertex is less than 360 degrees, the pieces cannot lie in the same plane. In this preferred embodiment of the invention the sum of the interior angles of the four pieces which have a common vertex is 358.39 degrees. Because the difference between this sum and 360 degrees is small, the appearance of continuous curvature is not easily seen until a relatively large number of pieces have been interconnected. It is obvious to an observer that the surface comprising the assembled puzzle pieces is not a plane surface and that it is beginning to take a shape which is polyhedral and which, to the human eye, appears spherical.

Figure 8:
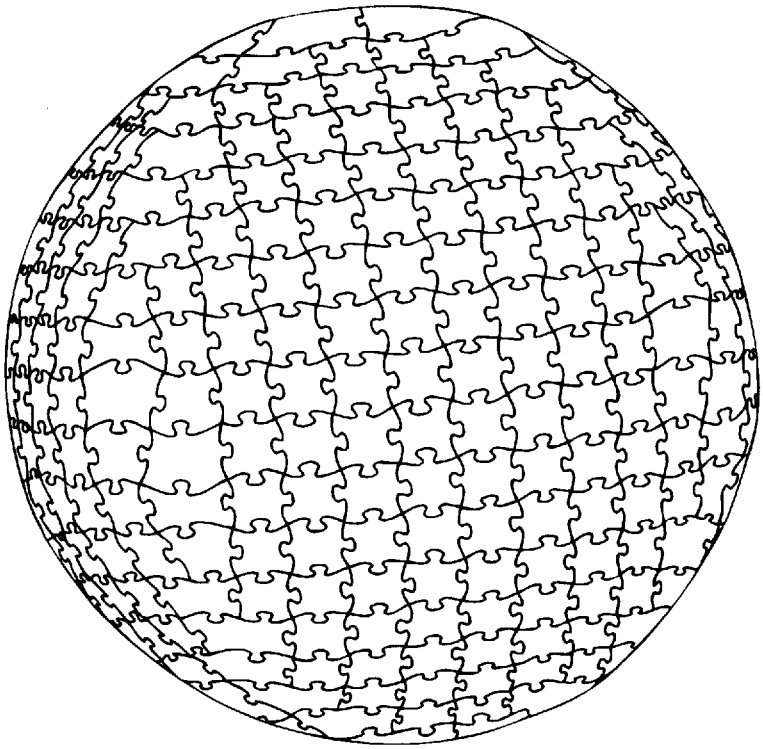
FIG. 8 shows all 530 pieces of the preferred embodiment assembled, interlocked edge to edge.

In FIG. 8 all of the pieces of the preferred embodiment of the continuously curving polyhedral surface jigsaw puzzle are shown assembled edge to edge. The interlocking forces keep the pieces in a self-supporting, rigid condition. It can be seen that the interlocked, continuously curving polyhedral surface appears to be spherical.

BRIEF SUMMARY OF THE INVENTION

It will be obvious to anyone familiar with jigsaw puzzles that a puzzle in which the planar pieces interlock edge to edge to form a continuously curving, self supporting polyhedral surface represents a new and completely unique invention which can be applied to achieve many different shapes. One of the possible shapes is a completely closed continuously curving polyhedral surface which closely approximates a sphere, whose vertices lie on a circumscribed sphere, and whose faces are tangent to an inscribed sphere. It is also evident that by reducing the sum of the angles of jigsaw puzzle pieces around a common point to a value less than 360 degrees, a continuously curving polyhedral surface can be formed and the major object of the present invention has been achieved. By cutting the male coupling elements with a larger loop of knife than those used for the female coupling elements, interlocking forces are introduced which can make the puzzle surfaces self-supporting and a second object of the invention has been achieved.

Having set forth the disclosure of our invention, we claim:

1. A jigsaw puzzle comprising:

a plurality of rigid and planar pieces;

a plurality of interlocking cooperative pairs of coupling elements formed in said pieces to interlock edge to edge each adjacent piece to another adjacent piece to form a self supporting surface with all of said plurality of pieces interlocking to form a continuous surface; and at least one corner angle formed in each of said pieces, said corner angle having a predetermined angle, wherein when at least three of said pieces are interlocked to form interlocking pieces which meet at and completely surround in said continuous surface a common point, a sum of total measurements of said corner angles of said interlocking pieces is less than three hundred sixty degrees when each of said corner angles is measured with said common point as a vertex of each of said corner angles of said interlocking pieces.

2. The jigsaw puzzle in claim 1 in which the pieces form a polyhedral surface.

3. The jigsaw puzzle as in claim 1 in which the pieces from a closed polyhedral surface.

4. The jigsaw puzzle as in claim 1 in which the pieces form a closed polyhedral surface and the vertices of said surface lie on a circumscribed sphere.

5. The jigsaw puzzle as in claim 1 in which the puzzle pieces are faces of a closed polyhedral surface and are all tangent to an inscribed sphere.

6. The jigsaw puzzle as in claim 1 in which at least half of the male coupling elements of the interlocking cooperative pairs of coupling elements are as large as or slightly larger than their respective female coupling elements.

7. The jigsaw puzzle as in claim 1 in which the polyhedral surface is closed and the vertices of the polyhedral surface lie on the surface of a circumscribed sphere and at least half of the interlocking cooperative pairs of coupling elements have a male element which is as large as or slightly larger than its respective female coupling element.

8. A jigsaw puzzle comprising a plurality of rigid, planar, interlocking pieces which connect edge to edge by means of interlocking cooperative pairs of coupling elements, in which at least three pieces meet at and form a continuous, self supporting surface about a common point on said self supporting surface with said common point as the vertex of the common corner angles of said at least three pieces and wherein the sum of said common corner angles consecutive about said common point is less than three hundred sixty degrees, each of said common corner angles measured in the plane of its piece with said common point as vertex.

9. The jigsaw puzzle as in claim 8 in which the pieces form a polyhedral surface.

10. The jigsaw puzzle as in claim 8 in which the pieces form a closed polyhedral surface.

11. The jigsaw puzzle as in claim 8 in which the pieces form a closed polyhedral surface and the vertices of said surface lie on a circumscribed sphere.

12. The jigsaw puzzle as in claim 8 in which the puzzle pieces are faces of a closed polyhedral surface and are all tangent to an inscribed sphere.

13. The jigsaw puzzle as in claim 8 in which at least half of the male coupling elements of the interlocking cooperative pairs of coupling elements are as large as or slightly larger than their respective female coupling elements.

14. A jigsaw puzzle comprising:

a plurality of rigid and planar pieces;

a plurality of interlocking cooperative pairs of coupling elements formed in said pieces to interlock edge to edge each adjacent piece to another adjacent piece to form a self supporting and continuously curving surface with all of said plurality of pieces interlocking to form a continuous surface; and at least one corner angle formed in each of said pieces, said corner angle being a predetermined corner angle, wherein when at least three of said pieces are interlocked to form interlocking pieces which meet at and completely surround in said continuous surface a common point, the summation of measurements of said predetermined corner angles of said interlocking pieces is less than three hundred sixty degrees when each of said predetermined corner angles is measured in the plane of its piece with said common point as its vertex.

15. The jigsaw puzzle as in claim 14 in which the pieces form a polyhedral surface.

16. The jigsaw puzzle as in claim 14 in which the pieces from a closed polyhedral surface.

17. The jigsaw puzzle as in claim 14 in which the pieces form a closed polyhedral surface and the vertices of said surface lie on a circumscribed sphere.

18. The jigsaw puzzle as in claim 14 in which the puzzle pieces are faces of a closed polyhedral surface and are all tangent to an inscribed sphere.

19. The jigsaw puzzle as in claim 14 in which at least half of the male coupling elements of the interlocking cooperative pairs of coupling elements are as large as or slightly larger than their respective female coupling elements.

20. The jigsaw puzzle as in claim 14 in which the polyhedral surface is closed and the vertices of the polyhedral surface lie on the surface of a circumscribed sphere and at least half of the interlocking cooperative pairs of coupling elements have a male element which is as large as or slightly larger than its respective female coupling element.

* * * * *